US006237163B1

(12) United States Patent
Guzzo et al.

(10) Patent No.: US 6,237,163 B1
(45) Date of Patent: May 29, 2001

(54) VENTILATED TOILET SEAT SYSTEM

(76) Inventors: Joseph Guzzo; Elena Guzzo, both of 400 Hulton Rd., Lower Burrell, PA (US) 15068-9742

( * ) Notice: Subject to any disclaimer, the term of this patent is extended or adjusted under 35 U.S.C. 154(b) by 0 days.

(21) Appl. No.: 09/464,319

(22) Filed: Dec. 16, 1999

(51) Int. Cl.[7] ..... E03D 9/04; A47K 13/00
(52) U.S. Cl. ..... 4/213; 4/217; 4/352
(58) Field of Search ..... 4/217, 213, 237, 4/347, 348, 352

(56) References Cited

U.S. PATENT DOCUMENTS

| | | | | |
|---|---|---|---|---|
| D. 336,331 | | 6/1993 | Arroyo | D23/311 |
| 2,172,506 | | 9/1939 | Gerger | 4/217 |
| 3,230,551 | * | 1/1966 | Kopp | 4/213 |
| 4,556,999 | | 12/1985 | Lindley | 4/217 |
| 4,620,329 | | 11/1986 | Wix | 4/217 |
| 4,780,913 | * | 11/1988 | Williams | 4/217 |
| 5,452,481 | | 9/1995 | Meyer | 4/213 |
| 6,016,576 | * | 1/2000 | Happe | 4/213 |
| 6,052,837 | * | 4/2000 | Norton et al. | 4/217 |

FOREIGN PATENT DOCUMENTS

WO90/06404 6/1990 (WO) .

* cited by examiner

*Primary Examiner*—Gregory L. Huson

(57) ABSTRACT

An improved system for ventilating air around a toilet where air is drawn through holes in a covered groove in the toilet seat and pulled by suction through a channel and hose to an output end of the fan housing. Alternatively, the air may be filtered and recycled or placed in a vent.

6 Claims, 1 Drawing Sheet

VENTILATED TOILET SEAT SYSTEM

BACKGROUND OF THE INVENTION

1. Field of the Invention

The present invention relates to a ventilated toilet seat system.

2. Description of the Prior Art

Ventilated toilet seats are known in the prior art. U.S. Pat. No. 4,556,999 to Lindley discloses an apparatus for removing noxious fumes and gases from a commode bowl comprising a toilet seat with circumferentially arranged radially directed inward air passages and a suction pump. U.S. Pat. No. 4,620,329 to Wix discloses a ventilated toilet seat having an internal channel that conveys air through the hinge mechanism of the seat to an exhaust fan. U.S. Pat. No. 5,452,481 to Meyer discloses a portable ventilation system comprising an air duct, a filter and a control unit. U.S. Pat. No. 2,172,506 to Gerger discloses a ventilating attachment to be placed between the bowl and the seat, a motor and a suction device. International Publication WO 90/06404 to Hunnicutt discloses a toilet bowl ventilating system housed within the lid of the seat. A need exists for an improved system that can be manufactured inexpensively, installed easily and maintained easily.

SUMMARY OF THE INVENTION

The invention meeting the needs identified above is a system where air is drawn through holes in a covered groove in the toilet seat and pulled by suction through a channel and hose to an output end of the fan housing. Alternatively, the air may be filtered and recycled or placed in a vent to the outside of the house.

The foregoing and other objects, features and advantages of the invention will be apparent from the following more particular description of a preferred embodiment of the invention, as illustrated in the accompanying drawings wherein like reference numbers represent like parts of the invention.

DESCRIPTION OF PREFERRED EMBODIMENTS

Figure 1:
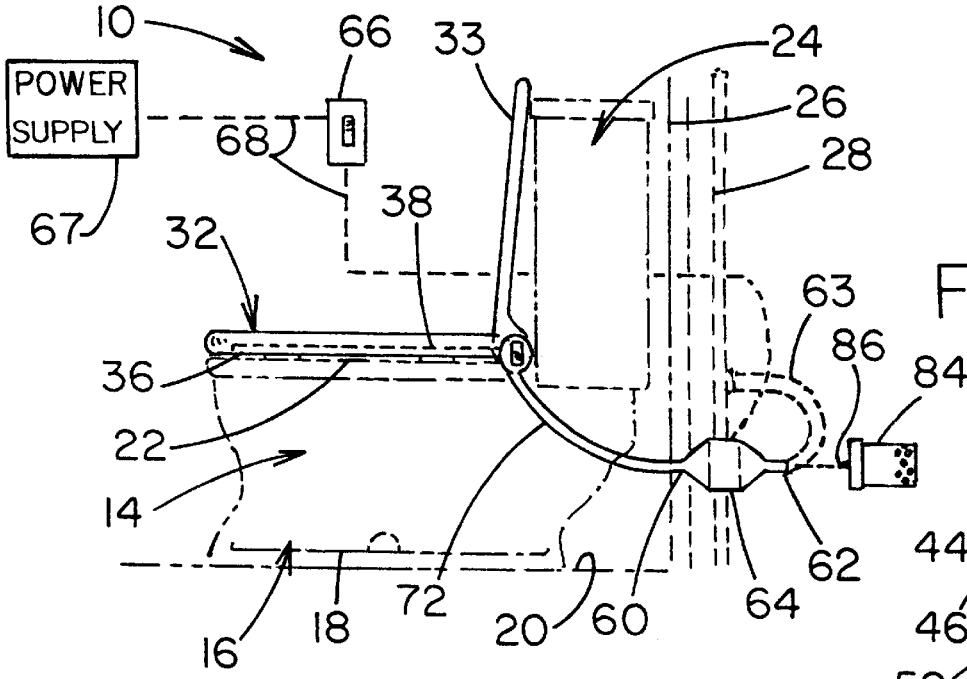
FIG. 1 is a side view of the system.
Figure 3:
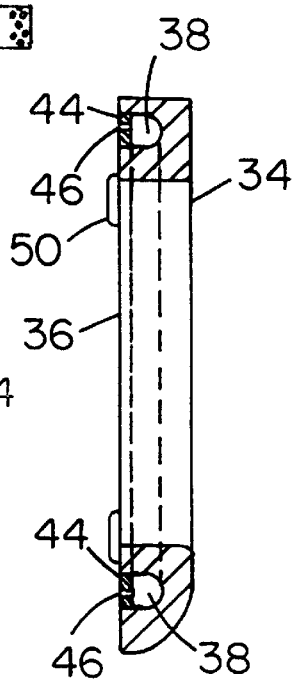
FIG. 3 is a cross sectional view of the seat along line 3—3.
Figure 2:
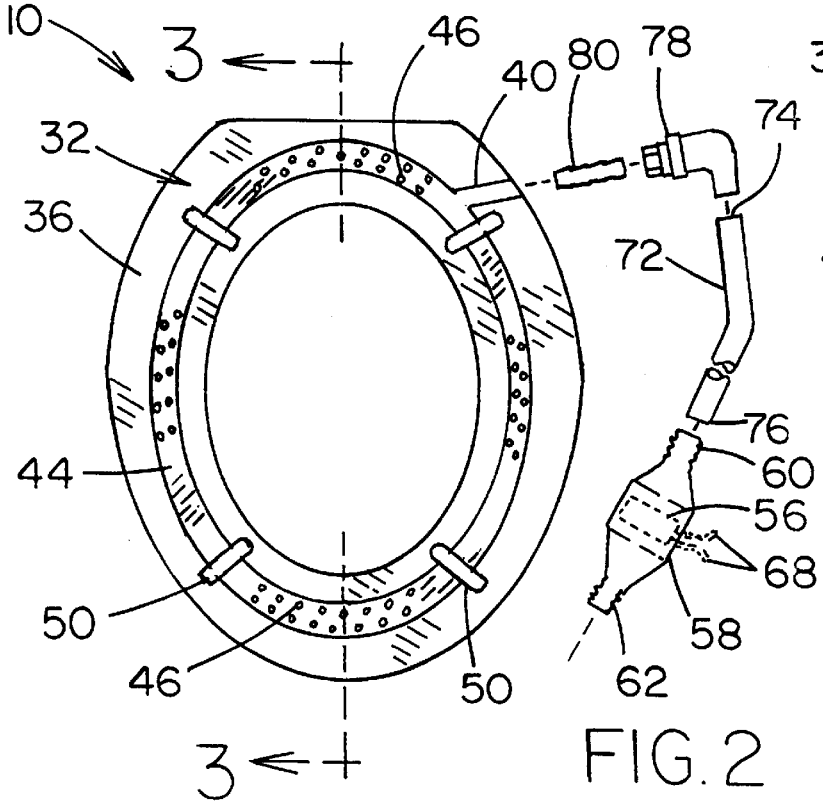
FIG. 2 is a bottom view of the seat, connector, hose and fan.

Referring to FIG. 1 and FIG. 2, Ventilation system 10 has seat 32, sheet 44, bumpers 50, fan 56, hose 72, fitting 78, filter 84 and vent 28. Ventilation system 10 is designed for attachment to toilet 14. Toilet 14 has support 16 with bottom 18 positioned on floor 20 and top 22. Tank 24 is positioned in front of wall 26. Vent 28 is located behind wall 26.

Seat 32 has lid 33 having upper surface 34 and lower surface 36. Seat 32 is pivotally connected to top surface 22 of toilet 14. Lower surface 36 has groove 38 extending within seat 32. Lower surface 36 has a recess (not shown) adjacent to groove 38 for receiving sheet 44 where the recess has a depth equal to the thickness of sheet 44 and a width equal to or slightly greater than the width of sheet 44. Seat 32 may have groove 38 molded during manufacture. Alternatively, seat 32 may have groove 38 cut out as part of the manufacturing process. Also, existing manufactured toilet seats may be modified by cutting groove 38 in them to create seats 32. Groove 38 runs continuously inside the generally oval shape of seat 32. Channel 40 connects groove 38 with the outside of seat 32 and ends in an opening capable of receiving connector 80. Sheet 44 fits above groove 38 and within lower surface 36 so that the sheet 44 does not protrude above the plane of lower surface 36. Sheet 44 has a plurality of holes 46. In the preferred embodiment, holes 46 have a diameter of approximately 1/16th inch and groove 38 is approximately 5/8 inch wide and1/2 inch deep. In the preferred embodiment, sheet 44 is made to of transparent plexiglass. However, persons skilled in the art will be aware of a variety of suitable materials for sheet 44. Groove 38 and sheet 44 with holes 46 create a duct within seat 32. Bumpers 50 are positioned so that the length of bumpers 50 span sheet 44 and bumpers 50 are affixed to lower surface 36. Bumpers 50 are fixedly connected to lower surface 36 thereby retaining sheet 44 in position. In the preferred embodiment there are four bumpers 50. However, persons skilled in the art will be aware that any number of bumpers 50 can be utilized and that there are alternate ways to hold sheet 44 in position adjacent to groove 38 and within lower surface 36. Fan 56 is completely enclosed by housing 58. Fan 56 is a standard 4" fan powered by standard household alternating current (AC). Fan 56 is configured to provide suction when powered thereby drawing air from seat 32 into fan 56. Fan 56 may be positioned between seat 32 and wall 26 for easy access. Fan 56 may be positioned in or behind wall 26. As a further alternative, fan 56 could be positioned on wall 26. Housing 58 has input end 60 and output end 62. Housing 58 has casing 64 for access to fan 56. Fan 56 has switch 66 positioned in the vicinity of toilet 14. In the preferred embodiment, switch 66 would be positioned on the wall nearest a side of toilet 14. Wires 68 connect to 56 and run through casing 64 to fan to switch 66 and to power supply 67.

Hose 72 has first end 74 and second end 76. In the preferred embodiment, hose 72 is a 0.75 inch flexible hose. Fitting 78 is removably and sealingly engaged to first end 74. Connector 80 is removably and sealingly engaged to fitting 78 and to seat 32. Alternatively, connector 80 may be fixedly and sealingly engaged to fitting 78 and to seat 32. Persons skilled in the art will be familiar with a variety of available connectors capable of removable and sealable engagement and fixed and sealed engagement. Fitting 78 is removably and sealing engaged with channel 40. Alternatively, fitting 78 may be fixedly and sealingly engaged with channel 40. Persons skilled in the art will be familiar with a variety of available fittings capable of removable and sealable engagement and fixed and sealed engagement. Second end 76 is removably and sealingly connected to input end 60 of housing 58. Filter 84 has connecting end 86 which is removably 15 and sealingly engaged to output end 62 of housing 58. In the preferred embodiment, output end 62 is connected to vent 28 sending air outside of the house. Output end 62 and vent 28 may be connected by a vent connecting hose which would be a 0.75 inch flexible hose 63 like hose 72. In an alternative embodiment, output end 62 of housing 58 is attached to filter 84 and the filtered air will recycle throughout the room housing toilet 14 or whatever space in which 20 filter 84 may be placed. In the preferred embodiment, filter 84 is a charcoal filter. However, persons skilled in the art will be aware of other alternate and suitable filters.

When switch 66 is activated, fan 56 draws air through holes 46 in sheet 44. The air travels through channel 40, connector 80, fitting 78, hose 72, housing 58, and vent 28. Alternatively, air may travel through channel 40, connector 80, fitting 78, hose 72, housing 58 and filter 84.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

We claim:

1. An apparatus for ventilating air surrounding a toilet in a house comprising:

a seat having a groove running continuously inside said seat wherein said seat is substantially oval in shape and is adapted to be pivotally connected directly to said toilet without the need for a projection extending from said seat;

a sheet having a plurality of holes affixed within said groove;

a channel connecting said groove to an outside surface of said seat;

a connector removably and sealing engaged to said channel and to a fitting;

a hose removably and sealingly engaged to said fitting and to a housing having a fan; and wires connected to said fan, a switch having a first position and a second position and a power supply;

wherein, when said switch is moved from said first position to said second position, said fan is activated causing said air to be drawn through said holes in said sheet and into said groove, channel, fitting, hose, and housing; and wherein said vent is adapted for sending said air outside of said house.

2. The apparatus of claim 1 further comprising a plurality of bumpers connected to said seat.

3. The apparatus of claim 1 further comprising a filter connected to said housing.

4. The apparatus of claim 1 further comprising a lid.

5. An apparatus for ventilating air surrounding a toilet in a house comprising:

a seat having a groove running continuously within said seat wherein said seat is substantially oval in shape and is adapted to be pivotally connected directly to said toilet without the need for a projection extending from said seat;

a sheet having a plurality of holes affixed within said groove;

a plurality of bumpers affixed to said seat so that said sheet is held in position within said groove;

a channel connecting said groove to an outside surface of said seat;

a connector removably and sealing engaged to said channel and to a fitting;

a hose removably and sealingly engaged to said fitting and to a housing having a fan;

a vent connected to said housing;

wires connected to said fan, a switch having a first position and a second position and a power supply;

wherein, when said switch is moved from said first position to said second position, said fan is activated and causes said air to be drawn through said holes in said sheet and into said groove, channel, fitting, hose, housing, and vent;

wherein said vent is adapted for sending said air outside of said house.

6. A method for ventilating the air surrounding a toilet in a house comprising;

connecting a seat having a continuous groove, a sheet and a channel directly to said toilet without a projection extending from said seat;

inserting a connector into said channel and a fitting;

connecting said fitting to a hose;

connecting said hose to a housing having an output end and a fan having wires;

connecting said output end to a vent adapted for sending air outside of said house;

connecting said wires to a switch having a first position and a second position, said switch being connected to a power supply; and activating said fan by moving said switch from said first position to said second position.

* * * * *